United States Patent [19]

Knaus

[11] 3,966,052

[45] June 29, 1976

[54] ARRANGEMENT FOR KEEPING TOOLS OF THE DRILLING, MILLING, BORING TYPE ETC. IN READINESS FOR USE ON MACHINE TOOLS

[76] Inventor: Reto Knaus, Ueberlandstrasse 309, 8051 Zurich, Switzerland

[22] Filed: May 15, 1974.

[21] Appl. No.: 470,079

[30] Foreign Application Priority Data

Feb. 4, 1974 Switzerland ..... 1594/74

[52] U.S. Cl. ..... 211/60 T; 211/70; 211/129; 211/163; 248/145

[51] Int. Cl.[2] ..... A47F 7/00

[58] Field of Search ..... 211/60, 69, 70, 129, 211/131, 1.5, 78, 163, 144, 60 T, 77, 53, 69.1; 108/139, 94, 95; 248/131, 145, 127, 126; 29/568

[56] References Cited

UNITED STATES PATENTS

| | | | |
|---|---|---|---|
| 432,616 | 7/1890 | Herrick | 211/70 |
| 652,257 | 6/1900 | Folger | 211/163 |
| 1,162,290 | 11/1915 | Koken | 211/78 |
| 1,391,222 | 9/1921 | Fleet | 248/415 |
| 2,009,485 | 7/1935 | Dodge | 211/144 |
| 2,281,849 | 5/1942 | McCoppin | 211/77 |
| 2,464,690 | 3/1949 | Ketchem | 108/95 |
| 3,063,568 | 11/1962 | Ladenheim et al. | 211/77 |
| 3,266,857 | 8/1966 | Anderson | 211/144 |
| 3,805,965 | 4/1974 | Champagne | 211/163 |

*Primary Examiner*—Roy D. Frazier
*Assistant Examiner*—Robert A. Hafer
*Attorney, Agent, or Firm*—Karl F. Ross; Herbert Dubno

[57] ABSTRACT

A tool holder for the shank tools of a drilling, boring or milling machine comprises a table having a pair of vertically spaced coaxial horizontal disks including a smaller diameter upper disk and a larger diameter lower disk and spacer holding the disks apart and connecting them together. The table is mounted upon a flanged shaft which is rotatable in a bearing sleeve containing friction means limiting the rotation of the table. The upper disk is formed with rectangular arrays of tapered or nontapered holes adapted to receive tool shanks while the lower disk is provided outside the outline of the upper disk with circular arrays of holes with the holes of each array lying between the holes of an adjacent array.

4 Claims, 6 Drawing Figures

ARRANGEMENT FOR KEEPING TOOLS OF THE DRILLING, MILLING, BORING TYPE ETC. IN READINESS FOR USE ON MACHINE TOOLS

Arrangements of the type known heretofore for holding shank-type tools in readiness for use in machine tools are awkward to use when changing tools and also involve a heightened risk of accident.

The present invention relates to an improved arrangement for holding in readiness for use on machine tools, e.g. horizontal and vertical boring mills, the tools to be used, such as drilling, milling, boring tools etc., in order to obtain a high tool mounting capacity with tidy layout and easy accessibility of the tools subject to frequent changing there is provided a tool carrier with two vertically spaced plates, the upper plate having a smaller diameter than the lower plates. Both plates are provided with holes to receive tools with tapered shanks or stepped blind hole sockets for tools with cylindrical shanks, the tool carrier being supported by a pivot shaft in the bearing bush of a holder having a braking device so as to be rotatable into any position and held friction-tight in position.

The accompanying drawing shows two embodiments of the invention. In the drawing.

Figures 1, 2:
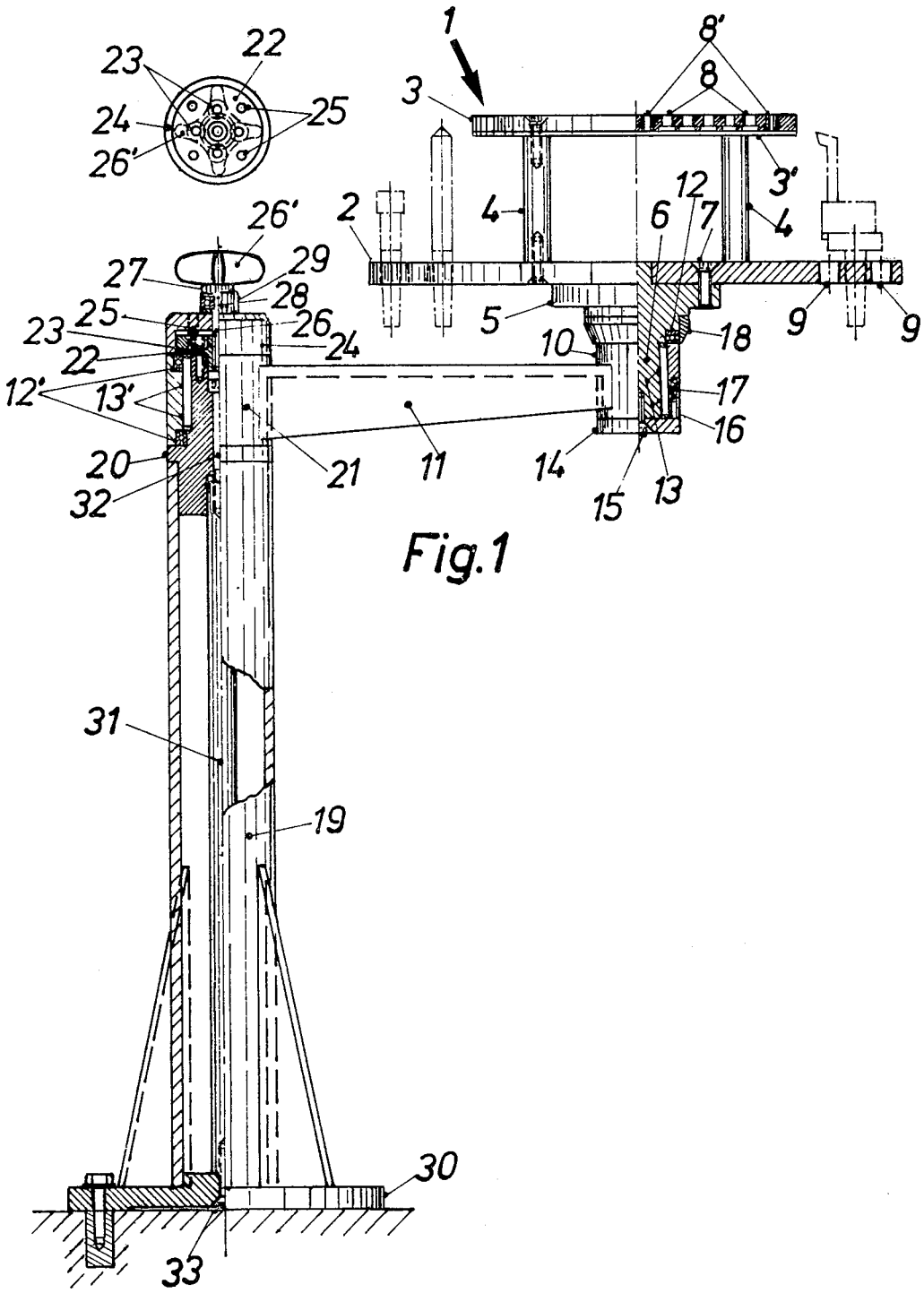
FIG. 1 is a side view of an arrangement mounted on a floor stand, shown partly in axial section and partly broken away.
FIG. 2 is a detail view of a portion of the device of FIG. 1 as viewed from below.
Figure 5:
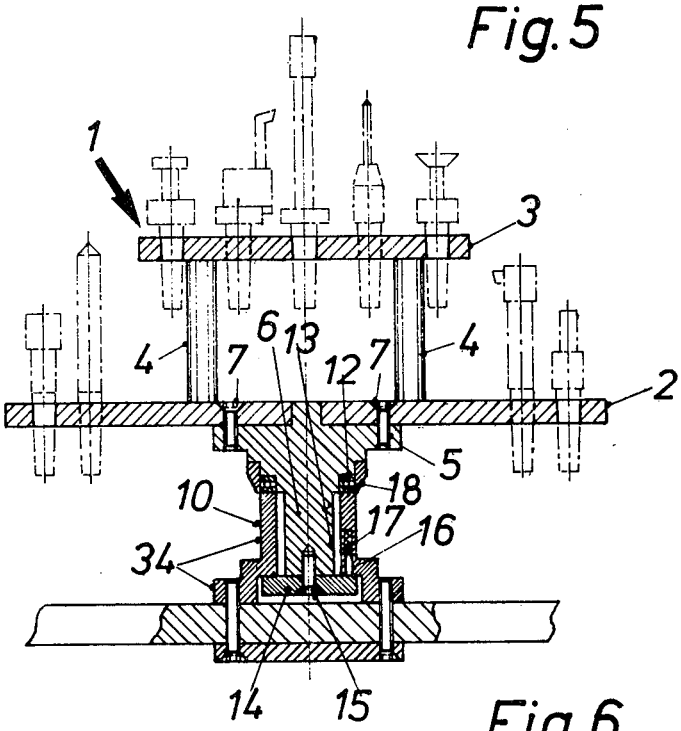
FIG. 5 is a side sectional view of a tool carrier according to another embodiment mounted on a flanged bush.

Referring more particularly to FIGS. 1 and 5, the arrangement shown has a tool carrier 1, comprising two circular plates or disks 2 and 3, with the lower plate larger in diameter than the upper one. The two plates are arranged in spaced relation, one above the other, and joined together by four spacing supports or posts 4.

Preferably, the two plates 2 and 3 are made of a plastic material such as "Resofil". The lower plate 2 is fixed horizontally on the flange 5 of a vertical pivot 6 by means of screws 7. Due to its easily accessible position, as raised above plate 2, the smaller upper plate 3 has stepped holes 8 over its entire surface, whereas the larger lower plate 2 has tapered holes 9 only in the annular surface outside the vertical projection of the upper plate 3.

Figure 3:
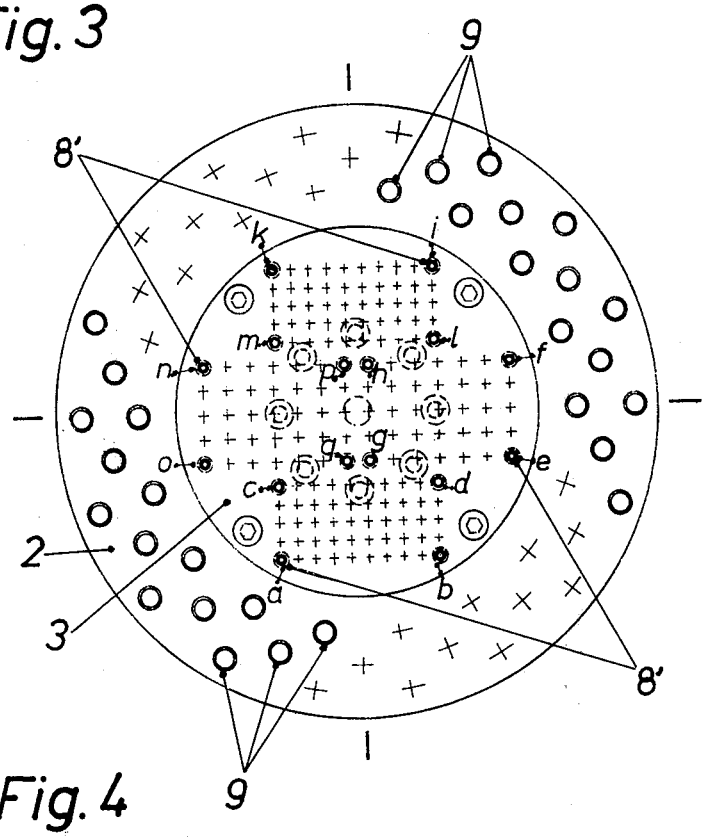
FIG. 3 is a top view of the tool carrier.

In the embodiment of the tool carrier 1 according to FIG. 1, the stepped holes 8 of the smaller upper plate 3 serve to take stepped blind hole sockets 8′ of brass, that are inserted from below. A disk 3′ fitted on the underside of plate 3 prevents the stepped blind hole sockets 8′ from being pushed out below downwardly, while the shoulder formed by their steps prevents them being displaced upward. As shown in FIG. 3, when viewed from above the stepped blind hole sockets 8′ of the upper plate 3 are arranged in rectangular arrays or groups: a-b-c-d, e-f-g-h, i-k-l-m, and n-o-p-q. The tools can be conveniently arrayed on the upper plate 3 (FIGS. 1 and 3) so that when the tool carrier 1 is turned through 90° the tool with the smallest diameter is always at the front left — looking from the respective group toward the center of the plate — while the tool with the biggest diameter is at the right rear. Accordingly the tools should be arranged with their diameters increasing from left to right and from front to rear in each group.

The holes 9 in the larger lower plate 2 are tapered. While the stepped blind hole sockets 8′ of the upper plate 3 are adapted to take twist drills and reamers with cylindrical shanks, the tapered holes 9 of the larger lower plate 2 take drilling, milling and boring tools etc. with conical (i.e. tapered) shanks. The tool holes 9 of each pitch circle are displaced by half the pitch in relation to the adjacent pitch circle in the circumferential direction, i.e. the tapered holes 9 are staggered.

The tool carrier 1 is shown in FIG. 1 as being supported with 360° swivel on the end of a swing arm 11, by means of pivot 6 in bearing bush 10, with a needle thrust bearing 12 and two radial needle bearings 13. A spacer disk 14 is rigidly joined to pivot 6 by a screw 15, defining the axial play of pivot 6 in bearing bush 10. A lock pin 16 is forced by a compression spring 17 against the spacer disk 14 to hold the tool carrier 1 friction-tight in the desired position of rotation. A protection ring 18 is forced onto the flange 5 from below to exclude dirt from the needle thrust bearing 12.

Figure 4:
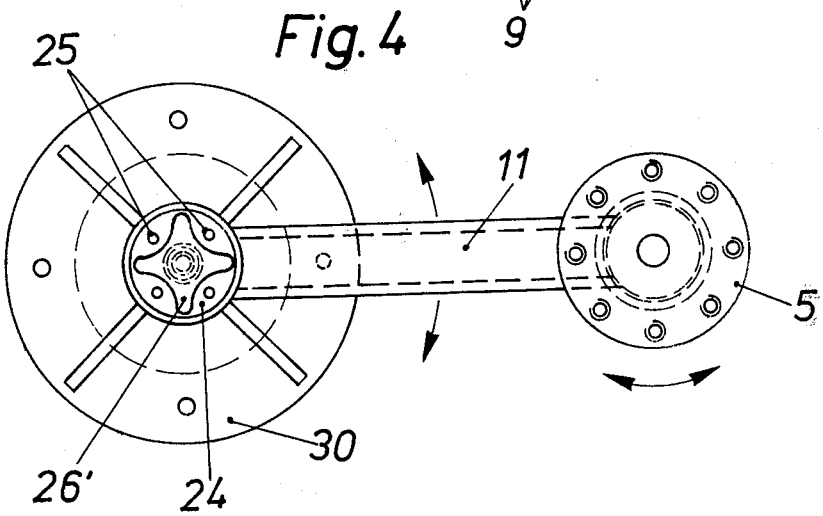
FIG. 4 is a top view of the device of FIG. 1, with the tool carrier removed.

In the embodiment shown in FIGS. 1 and 4 the tool carrier 1 is revolubly mounted on the swing arm 11 rotating through 360° on a floor stand 19. Fixed at the top of stand 19 and coaxial therewith is the bearing pivot 20 carrying the swing arm 11 swivelling through 360 degrees by means of the pivot bush 21. The load acting upon swing arm 11 is taken up by two combined ball thrust and needle radial bearings 12′ and 13′. A spacer disk 22 is joined to bearing pivot 20 by screws 23. The spacer disk 22 is surrounded by a brake bell 24 which rests on the top edge of pivot bearing bush 21. The brake bell 24 carries downwardly extending vertical guide pins 25 engaging correspondingly positioned holes in spacer disk 22, thus preventing same from rotation with bearing bush 21 when the swing arm 11 turns. A clamping screw 26 with a star handle 26′ passes through an axial hole in brake bell 24 and engages an axial threaded hole in spacer disk 22, resting with a collar 27 on a ball thrust bearing 28 which in turn rests against the annular shoulder of a protecting sleeve 29.

By tightening the clamping screw 26 to a greater or lesser extent, the pressure exerted by brake bell 24 on pivot bearing bush 21 may be varied to thus obtain any desired braking of the swing arm 11. The protective sleeve 29 keeps dirt out of the ball thrust bearing 28. The base plate 30 of floor stand 19 is joined to the bearing pivot 20 by the rod 31 running axially through the upright stand tube, whereby a connecting screw 33 secures the base plate 30 to the bottom end of rod 31, and a tightening screw 32 holds the bearing pivot 20 onto the top end of rod 31, so that by tightening screw 32 the bearing pivot 20 is firmly braced relative to stand tube 19.

Figure 6:
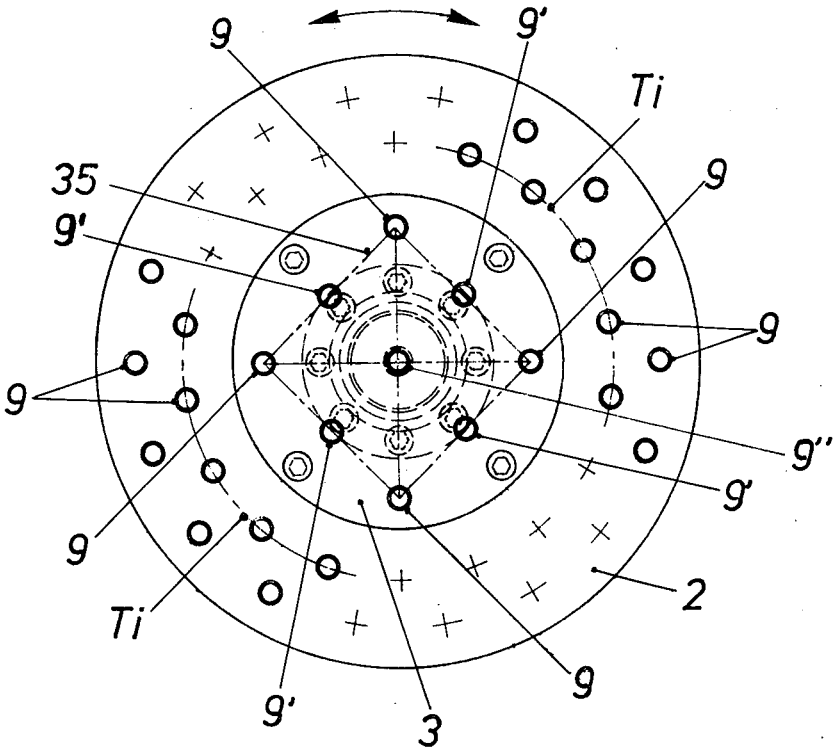
FIG. 6 is a top view of the device of FIG. 5.

In the embodiment shown in FIG. 6 the tool holes 9 and 9′ in the upper plate are arranged on the sides of a square 35 indicated in broken lines, with a further hole 9″ at the intersection of the diagonals. With this arrangement the holes 9′ are at a greater radial distance from the inner hole pitch circle Ti of the lower plate 2, and are therefore suitable for taking tools of larger diameter.

In the embodiment of the tool carrier according to FIGS. 5 and 6, the holes 9, 9′ and 9″ of the smaller upper plate 3 are tapered in order to take long, heavy tools like boring tools, cutter heads etc. with conical shanks, while the holes 9 in the larger lower plate 2 are also tapered to accomodate drilling, milling, boring tools etc. with conical shanks.

The arrangement according to FIGS. 5 and 6 dispenses with a stand and swing arm. Instead the bearing bush 10 carrying the pivot 6 of tool carrier 1 is in the form of a flanged bush 34, which enables the device to be mounted on a bench or the like.

What I claim is:

1. A tool holder for shank tools comprising:

a table having a horizontal large-diameter lower disk, and a small-diameter upper disk spaced above and coaxial with said lower disk, and spacer means interconnecting said disks for joint rotation in spaced-apart relation, said upper disk being formed with a rectangular array of holes each adapted to receive a tool shank, said lower disk being formed with at least one circular array of holes outwardly of the outline of said upper disk and adapted to receive tool shanks;

a flanged shaft having its flange connected to the underside of said lower disk and extending coaxially with said table;

a support sleeve rotatably receiving said shaft;

friction means between said sleeve and said shaft for retarding rotation of said shaft relative to said sleeve;

a base;

a tubular post mounted on said base;

a horizontal arm rotatable on said post and carrying said sleeve;

a tubular pivot in said post carrying said arm;

a rod extending through said post and interconnecting said pivot and said base;

further friction means on said post for frictionally retarding swinging movement of said arm relative to said post; and adjusting means on said post connected with said further friction means for adjusting the frictional retardation of said arm.

2. The tool holder defined in claim 1 wherein the holes in said upper plate are disposed in a plurality of rectangular groups angularly offset about the axis of the table from one another at an angle of 90° and so arranged that, when the table is turned through 90°, the tool with the smallest diameter is always at the front left as viewed toward the center of the table and the tool with the largest diameter is at the right rear with the diameter of the tools increasing from left to right and from front to rear in each group.

3. The tool holder defined in claim 1 wherein the holes of said lower disk are formed in a plurality of concentric circular arrays with the holes of each circular array being offset by half the pitch thereof relative to the holes of an adjacent circular array.

4. The tool holder defined in claim 1 wherein the holes of said upper disk are disposed along the sides of a square and said upper disk is further provided with another shank receiving hole at the intersection of the diagonals of said square.

* * * * *